US007814688B2

(12) United States Patent
Dananberg

(10) Patent No.: US 7,814,688 B2
(45) **Date of Patent: *Oct. 19, 2010**

(54) DEVICE FOR HIGH-HEELED SHOES AND METHOD OF CONSTRUCTING A HIGH-HEELED SHOE

(75) Inventor: Howard J. Dananberg, Bedford, NH (US)

(73) Assignee: HBN Shoe, LLC, Manchester, NH (US)

( * ) Notice: Subject to any disclaimer, the term of this patent is extended or adjusted under 35 U.S.C. 154(b) by 52 days.

This patent is subject to a terminal disclaimer.

(21) Appl. No.: 12/489,328

(22) Filed: Jun. 22, 2009

(65) Prior Publication Data

US 2009/0255148 A1 Oct. 15, 2009

Related U.S. Application Data

(60) Division of application No. 11/948,144, filed on Nov. 30, 2007, now Pat. No. 7,594,346, which is a division of application No. 10/964,532, filed on Oct. 13, 2004, now Pat. No. 7,322,132, which is a continuation-in-part of application No. 10/421,403, filed on Apr. 23, 2003, now abandoned.

(51) Int. Cl.
*A61F 5/14* (2006.01)
*A43B 21/24* (2006.01)

(52) U.S. Cl. ..... 36/174; 36/180; 36/34 R

(58) Field of Classification Search ..... 36/174, 36/180, 145, 34 R, 155–163, 173, 43, 30 R, 36/44

See application file for complete search history.

(56) References Cited

U.S. PATENT DOCUMENTS 1,287,810 A 12/1918 Wojteck
1,503,764 A 8/1924 Nickerson
1,550,715 A 8/1925 Stout
1,819,539 A 8/1931 Bringgardner
RE18,237 E 10/1931 Messler
1,847,287 A 3/1932 White
1,864,999 A 6/1932 Gluckman
1,907,997 A 5/1933 Nickerson
2,088,263 A 7/1937 Grouven ..... 36/8.5

(Continued)

FOREIGN PATENT DOCUMENTS

HU 209 953 2/1995

(Continued)

OTHER PUBLICATIONS

"New Styling for High-Heeled Comfort: The Classic Pump Redefined for Fashion Wear", Current Podiatric Medicine, Feb. 1990, (pp. 29-32).

(Continued)

*Primary Examiner*—Ted Kavanaugh
(74) *Attorney, Agent, or Firm*—Hayes Soloway P.C.

(57) ABSTRACT

A device for insertion in a high-heeled shoe has a first crescent shaped raised area in a region underlying the forward edge of a wearer's heel bone and a second raised area underlying the metatarsals of the wearer is described. Also described is a method for constructing a shoe using the device and the resulting shoe.

29 Claims, 5 Drawing Sheets

U.S. PATENT DOCUMENTS

| | | | | |
|---|---|---|---|---|
| 2,092,910 | A | 9/1937 | Daniels | 36/71 |
| 2,221,202 | A | 11/1940 | Ratchcliff | 36/71 |
| 2,246,944 | A | 6/1941 | Larkin | 36/71 |
| 2,304,384 | A | 12/1942 | Stemmons | 36/71 |
| D143,642 | S | 1/1946 | Bouthillette | D7/5 |
| 2,423,622 | A | 7/1947 | Samblanet | 36/71 |
| 2,558,317 | A | 6/1951 | Schwartz | 36/76 |
| 3,084,695 | A | 4/1963 | O'Donnell | 128/615 |
| 3,646,692 | A | 3/1972 | Glogg | 36/2.5 |
| 3,680,162 | A | 8/1972 | Glickman | 12/142 |
| 3,832,793 | A | 9/1974 | Siskin | 36/2.5 |
| 3,942,206 | A | 3/1976 | Diamant | 12/142 |
| 4,048,732 | A | 9/1977 | Stix | 36/34 |
| 4,073,024 | A | 2/1978 | Stix | 12/142 |
| 4,317,293 | A | 3/1982 | Sigle et al. | 36/43 |
| 4,367,599 | A | 1/1983 | Diamant | 36/44 |
| 4,451,949 | A | 6/1984 | Long | 12/46 |
| 4,631,841 | A | 12/1986 | Hickey | 36/91 |
| 4,670,996 | A | 6/1987 | Dill | 36/42 |
| 4,682,425 | A | 7/1987 | Simmons | 36/44 |
| 4,686,993 | A | 8/1987 | Grumbine | 128/581 |
| 4,689,898 | A | 9/1987 | Fahey | 36/43 |
| 4,835,884 | A | 6/1989 | Bianchini et al. | 36/24.5 |
| 4,852,275 | A | 8/1989 | Bianchini et al. | 36/102 |
| 4,866,860 | A | 9/1989 | Blissett et al. | 36/28 |
| 4,932,141 | A | 6/1990 | Hones | 36/43 |
| 4,955,148 | A | 9/1990 | Padilla | 36/44 |
| 5,146,697 | A | 9/1992 | Weiss | 36/12 |
| 5,174,052 | A | 12/1992 | Schoenhaus et al. | 36/144 |
| 5,373,650 | A | 12/1994 | Dananberg et al. | 36/92 |
| 5,632,104 | A | 5/1997 | Zohar | 36/88 |
| 5,685,094 | A | 11/1997 | Lin | 36/141 |
| 5,782,015 | A | 7/1998 | Dananberg | 36/34 |
| 5,787,608 | A | 8/1998 | Greenawalt | 36/11.5 |
| 6,253,469 | B1 | 7/2001 | Atlani et al. | 36/174 |
| 6,412,198 | B1 | 7/2002 | Rothbart | 36/144 |
| 6,510,626 | B1 | 1/2003 | Greenawalt | 36/43 |
| 7,264,604 | B1 | 9/2007 | Schuren et al. | 602/8 |
| 7,322,132 | B2 * | 1/2008 | Dananberg | 36/174 |
| 7,380,352 | B2 | 6/2008 | Seiter | 36/44 |
| 7,594,346 | B2 * | 9/2009 | Dananberg | 36/174 |

FOREIGN PATENT DOCUMENTS

| | | |
|---|---|---|
| JP | 10-234417 | 8/1998 |
| WO | WO 91/07152 | 5/1991 |
| WO | WO 98/14083 | 4/1998 |
| WO | WO 2004/093584 | 4/2004 |

OTHER PUBLICATIONS

"Shear Madness" Footwear News, vol. 53, No. 15.

Official Action received in Applicant's Mexican Patent Application Serial No. MX/a/2007/004383.

Official Action received in Applicant's related Japanese Patent Application Serial No. 2006-509840.

* cited by examiner

DEVICE FOR HIGH-HEELED SHOES AND METHOD OF CONSTRUCTING A HIGH-HEELED SHOE

CROSS-REFERENCE TO RELATED APPLICATIONS

This application is a divisional of U.S. application Ser. No. 11/948,144, filed Nov. 30, 2007, now U.S. Pat. No. 7,594,346, which is a divisional of U.S. application Ser. No. 10/964,532, filed Oct. 13, 2004, now U.S. Pat. No. 7,322,132, which is a continuation-in-part of U.S. application Ser. No. 10/421,403, filed Apr. 23, 2003, now abandoned.

STATEMENT REGARDING FEDERALLY SPONSORED RESEARCH OR DEVELOPMENT

Not applicable

BACKGROUND OF THE INVENTION

The present invention relates to a shoe that is easily constructed and provides greater comfort to the wearer without affecting the fit or style of the shoe. The invention has particular utility in connection with high-heeled shoes.

Conventional high-heeled shoes have a reputation for being extremely uncomfortable. There is survey information indicating that as many as 20% of the users of such shoes experience foot pain related to the shoes immediately, and the majority of users experience such pain after as little as four hours of use.

In order to understand the prior art and the present invention, it is necessary to understand the anatomy of the foot and the basics of shoe construction. To that end, FIG. 1 is a diagrammatic view of the bones of the foot and the portions of a shoe that underlie the sole of the foot. By reference to FIG. 1, the following briefly describes the anatomy of the foot and the basics of shoe construction.

FIG. 1 is a diagrammatic medial side view of the bones of the human foot 10. For purposes of this application, references to rearward mean in the direction of the rear of the foot or heel 20; references to forward mean in the direction of the front of the foot 30 where the toes or phalanges 31 are located; references to medial mean the side of the foot where the arch 40 is located; references to lateral mean the outside of the foot; and references to upper or top and lower, bottom or under assume the foot or shoe is oriented in an upright position.

The heel 20 (also known as the tarsus) includes the talus 21 and the calcaneus 22 bones The rear lower surface of the calcaneus 22 has a slight protuberance 23 known as the tuberosity of the calcaneus. The bones of the foot also include the navicular 41, the cuneiform 42, the metatarsals 45 and the phalanges, or toes, with the big toe 31 visible in FIG. 1. The metatarsal heads 46 are located at the forward end of the metatarsal shafts 47. The metatarsals are numbered 1 to 5, with 1 designating the big toe.

Also depicted in FIG. 1 is a partially exploded view of the portions of a conventional high-heeled shoe 50 that underlie the sole of the foot. Shoe 50 has a heel 51 which is generally attached to the lower surface of sole 52 of shoe 50, with the sole 52 in turn supporting the insole board 53 on which the sock liner 54 is placed. In a conventional shoe, the insole board is typically of relatively rigid construction from the region underlying the wearer's heel to the heads of the metatarsals. Sock liners are commonly very flexible and generally are very thin, typically no more than half a millimeter thick. The sock liner is the surface upon which the sole of the foot normally rests.

According to conventional shoe construction methods, the last is the form around which the shoe is constructed. During manufacture, the lower surface of the last sits on the upper surface of insole board, and the shoe upper is then shaped around the last and attached to the insole board. Optimally, the lower surface of the last and the upper surface of the insole board fit together smoothly in order to properly manufacture shoes. If there is any convexity on the lower surface of the last or the upper surface of the insole board respectively, a corresponding concavity must be present in the insole board or last respectively. To be assured of a quality shoe construction, any such convexity and corresponding concavity must be carefully aligned during shoe manufacture, thereby introducing added complexity and/or quality control issues to shoe manufacture.

As will be appreciated, a conventional high-heeled shoe such as shown in FIG. 1 places the wearer's foot essentially on an inclined plane. As a result, the foot is urged forward by gravity into the toe box in standing or walking. This results in pressure on the ball or forefoot regions and toe jamming which often gives rise to a burning sensation in these areas of the foot, as well as fatigue and discomfort in the foot and other areas of the body.

Numerous suggestions have been made for improving the comfort of high-heeled shoes, including suggestions in my prior patents and publications. For example, in a February 1990 article in *Current Podiatric Medicine*, pp. 29-32, I described a high-heeled shoe design in which the portion of the shoe under the heel does not form a continuous ramp down the arch to the ball of the foot, but rather the portion underlying the heel is relatively parallel to the ground. The design used a rigid plastic molded midsole which was cupped to receive the heel and angled to bring the heel into a plane more parallel with the floor. In addition, a metatarsal pad was incorporated into the molded midsole.

In U.S. Pat. No. 5,373,650, I proposed an orthotic under the heel. The orthotic is a rigid or semirigid shell under the heel and extending forward, with arch support, to a point behind the metatarsal heads of the foot. The heel in this device is supported parallel to the ground or tilted slightly backwards.

In U.S. Pat. No. 5,782,015, I have described a high-heeled shoe design in which the heel is positioned more parallel or slightly downwardly inclined angle relative to the shank plane and which has an arch support that supports the head of the navicular in approximately the same plane as the wearer's heel bones. My PCT Publication WO98/14083, published Apr. 9, 1998, describes a rigid molded device comprising a heel cup and an anatomically shaped arch appliance.

Numerous examples of designs by others intended to improve comfort of high-heeled shoes exist in the prior art. U.S. Pat. Nos. 1,864,999, 1,907,997, 4,317,293, 4,631,841, 4,686,993, 4,932,141 and 6,412,198 each describes shoe inserts or orthotics intended to improve comfort of a high-heeled shoe. Several involve arch supports. Some are rigid; others suggest cushioning as a means to improve comfort. The prior art inserts and orthotics typically are relatively bulky and can affect a shoe's fit if added by the wearer after manufacture. Other prior art proposals to improve wearer comfort require that each last used to manufacture the shoe be modified to change the shape of the shoe itself.

These prior art constructions improve comfort by supporting or cushioning parts of the foot and/or altering the foot angles to reduce sliding forward and/or to alter the percentage of the wearer's weight borne by different parts of the foot.

Their teachings suggest, among other things, placing the heel on a more level plane to shift the weight backward onto the heel, supporting the arch, angling the toes upward and/or cushioning the surfaces on which the largest percentage of weight is borne.

The present invention provides a thin flexible shoe insert which can readily be adapted to any style shoe and which can be incorporated into a shoe without requiring modifications to a shoe last, and the accompanying manufacturing complexity. The insert has two slightly raised areas under the heel and the metatarsals. Although the insert has two only slightly raised areas, it significantly increases wearer comfort even in very high heels. The insert does not require that the heel be repositioned to a plane parallel with the floor as is the case in some of the prior art. Other than in the two slightly raised areas, the insert can be extremely thin, thereby minimizing any effect on fit of the shoe and eliminating any adverse effect on the style or appearance of the shoe. Alternatively, the thin flexible insert can be placed in the shoe by the wearer.

BRIEF SUMMARY OF THE INVENTION

In accordance with the present invention, there is provided a device for insertion into a high-heeled shoe and a corresponding method of constructing shoes using the device. The device comprises (a) a rear region positioned to underlie the calcaneus in at least the area forward of the tuberosity of the calcaneus, the upper surface of said rear region having a portion which gradually rises from the rear of the device to a crescent shaped apex, said apex lying under the area forward of the tuberosity of the calcaneus and (b) a forward region positioned to underlie at least a portion of the shafts of the metatarsals, the upper surface of said forward region having a portion which gradually rises to an apex positioned to underlie the shafts of the second and third metatarsals. In the preferred embodiment, the device has a bridging or middle region which connects said forward and rear regions, the device is flexible and the upper surface of the device is smoothly contoured between all regions. A feature and advantage of the device of the present invention is that the device may be universally applied to conventional high-heeled shoes without the need to otherwise modify the shoes or the shoe last. A shoe may be constructed with the device according to the present invention by incorporating the device into the shoe during the manufacturing process or the device may be applied post-manufacture by the wearer.

DETAILED DESCRIPTION OF THE INVENTION

In the present invention, a device is provided which improves comfort and is easily installed in high-heeled shoes. For purposes of this invention, it is to be understood that high-heeled shoes include all footwear having a heel which is about one inch or higher. The benefits of the invention are achieved when a raised area is positioned in a shoe to underlie the metatarsal shafts and heel. Typically, the device of the invention is positioned on the insole board or sock liner of a high-heeled shoe. Preferably, the device is sufficiently flexible so that it readily conforms to the upper surface of the insole board or sock liner on which it is positioned. It may be formed of any materials known to those of ordinary skill in the art that can be molded or shaped and that will produce a device flexible under normal conditions of use of a shoe, while retaining sufficient dimensional stability to retain the benefit of the invention.

In the preferred embodiment, the device is shaped to underlie at least (i) the portion of the heel extending from the edge of the tuberosity of the calcaneus to the portion of the heel that is immediately forward of the tuberosity of the calcaneus and (ii) the area under the second and third metatarsal shafts. The device may extend beyond these areas and may be shaped to conform to the shape of the sock liner or insole board. Optimally, the device is narrower than the sock liner when it is to be positioned under the sock liner. This narrower size allows the edge of the sock liner to be adhered to the insole board along the edges of the device of the invention. Depending on the style of the shoes this narrower configuration may be particularly desirable.

The device has two distinct raised areas: a first distinct raised area that rises from the forward edge of the tuberosity of the calcaneus to a crescent-shaped apex underlying the calcaneus in the area forward of the tuberosity of the calcaneus of the wearer's foot, and a second distinct raised area located within a shoe to underlie the metatarsal shafts of the wearer's foot, with its apex under or between the second and third metatarsal shafts. The first and second raised areas are joined by a bridging or middle region. For clarity, it is to be understood that references to narrow and wide mean the side-to-side dimensions of the shoe or device while references to raised, lowered, thinness, depth or height mean the vertical dimensions of the device.

Figure 1:
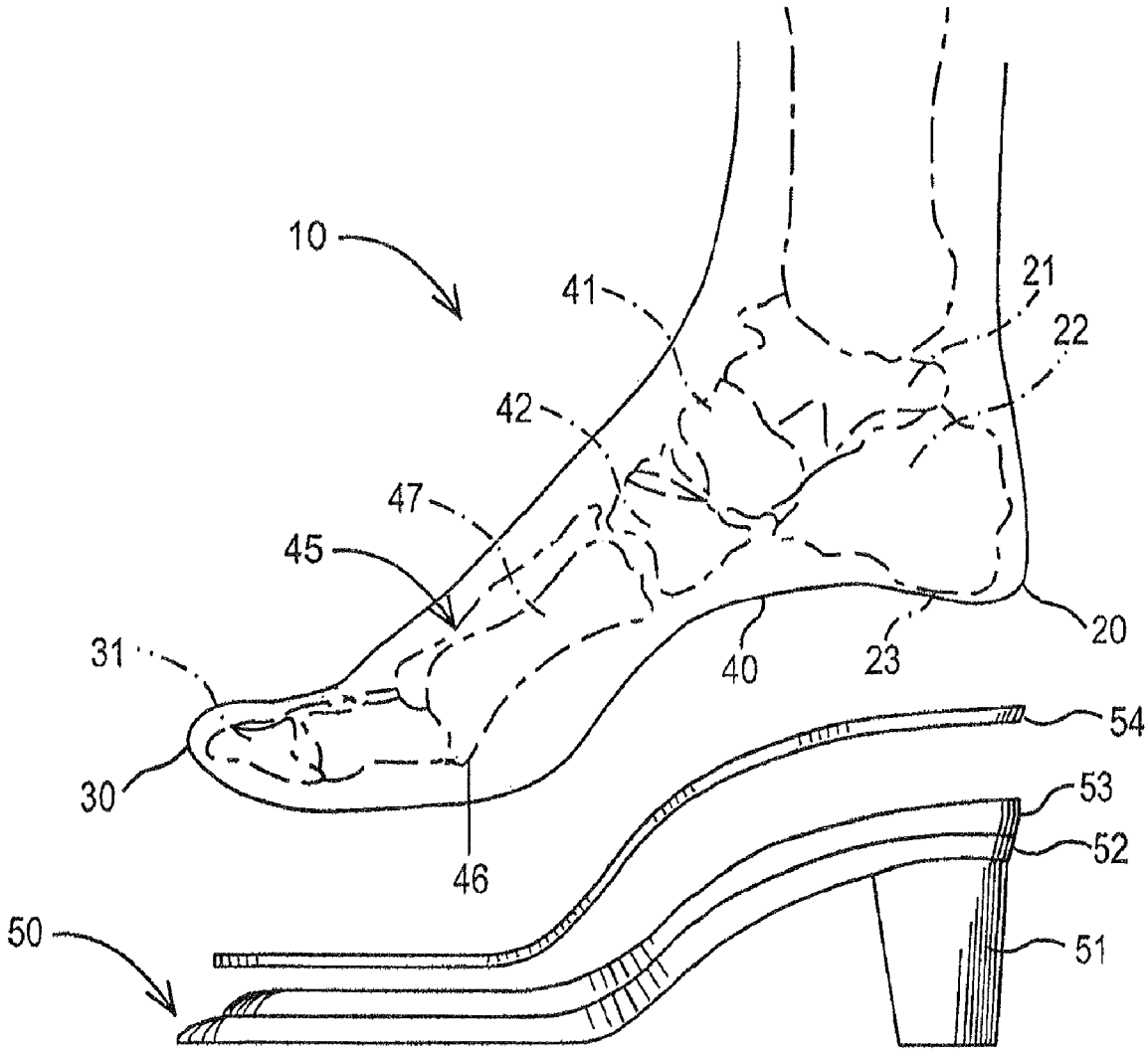
FIG. 1 PRIOR ART
FIG. 1 is a diagrammatic cross-sectional view of the foot bones and a partially exploded view of the portions of a conventional high-heeled shoe that underlie the sole of the foot.
Figure 2:
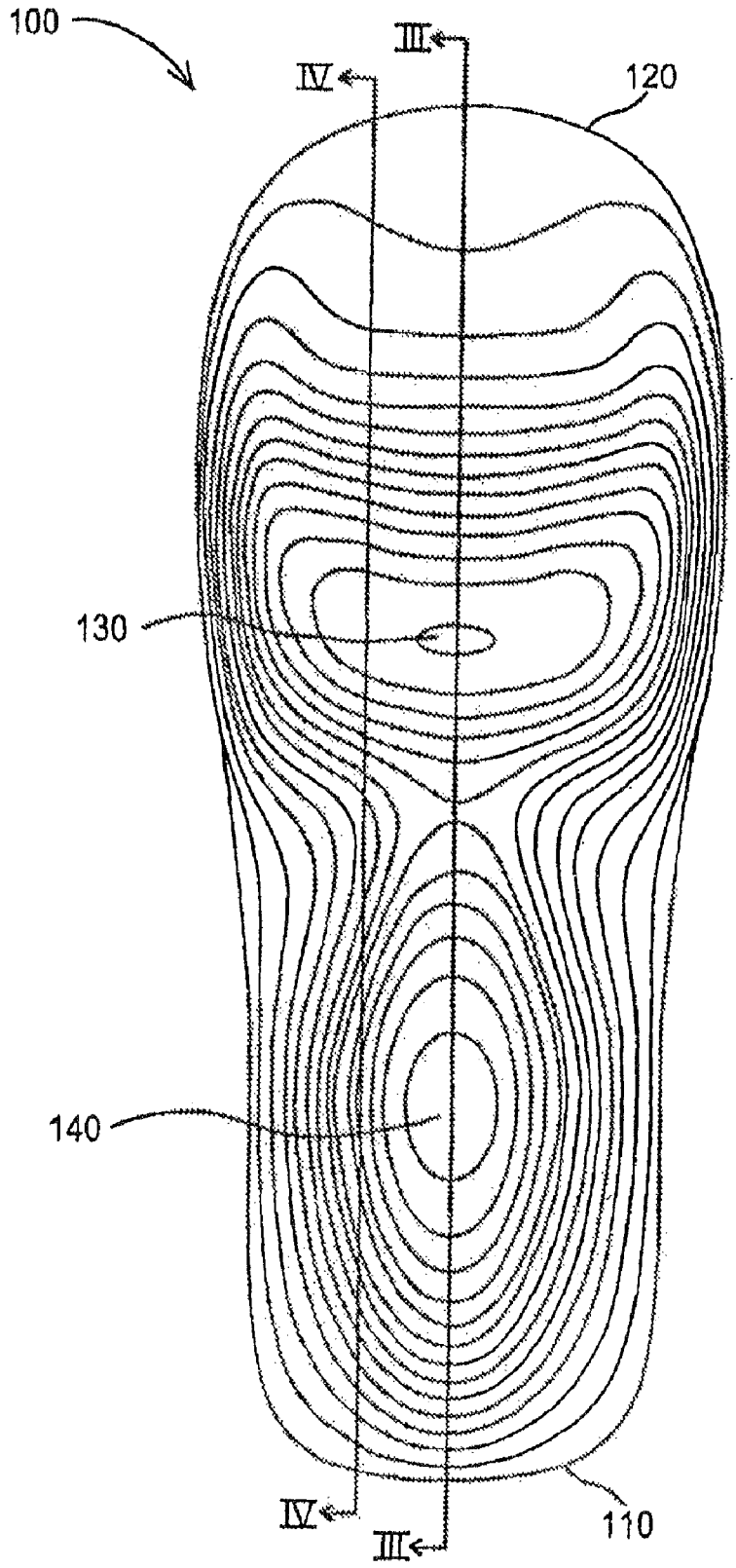
FIG. 2 is a top plan view of an embodiment of the device of the present invention.
Figure 3:
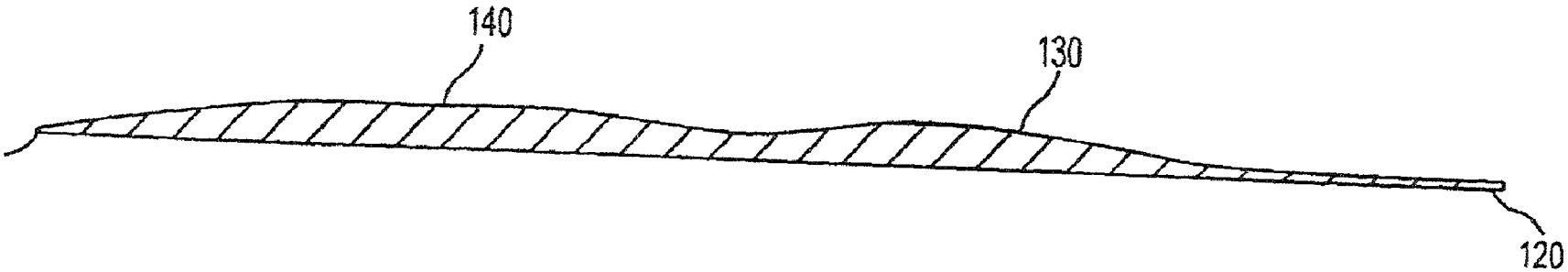
FIG. 3 is a side cross-sectional view of the device of the present invention shown in FIG. 2, taken along plane "III-III."
Figure 4:
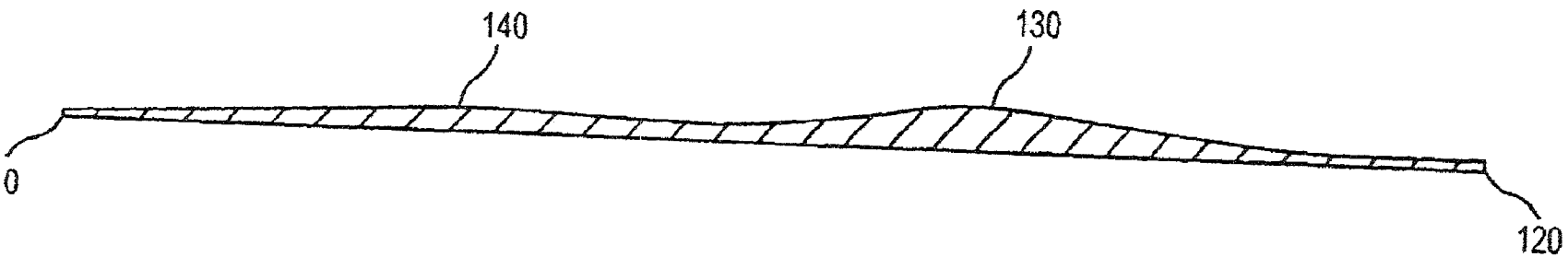
FIG. 4 is a side cross-sectional view of the device of FIG. 2, taken along plane "IV-IV."
Figure 5:
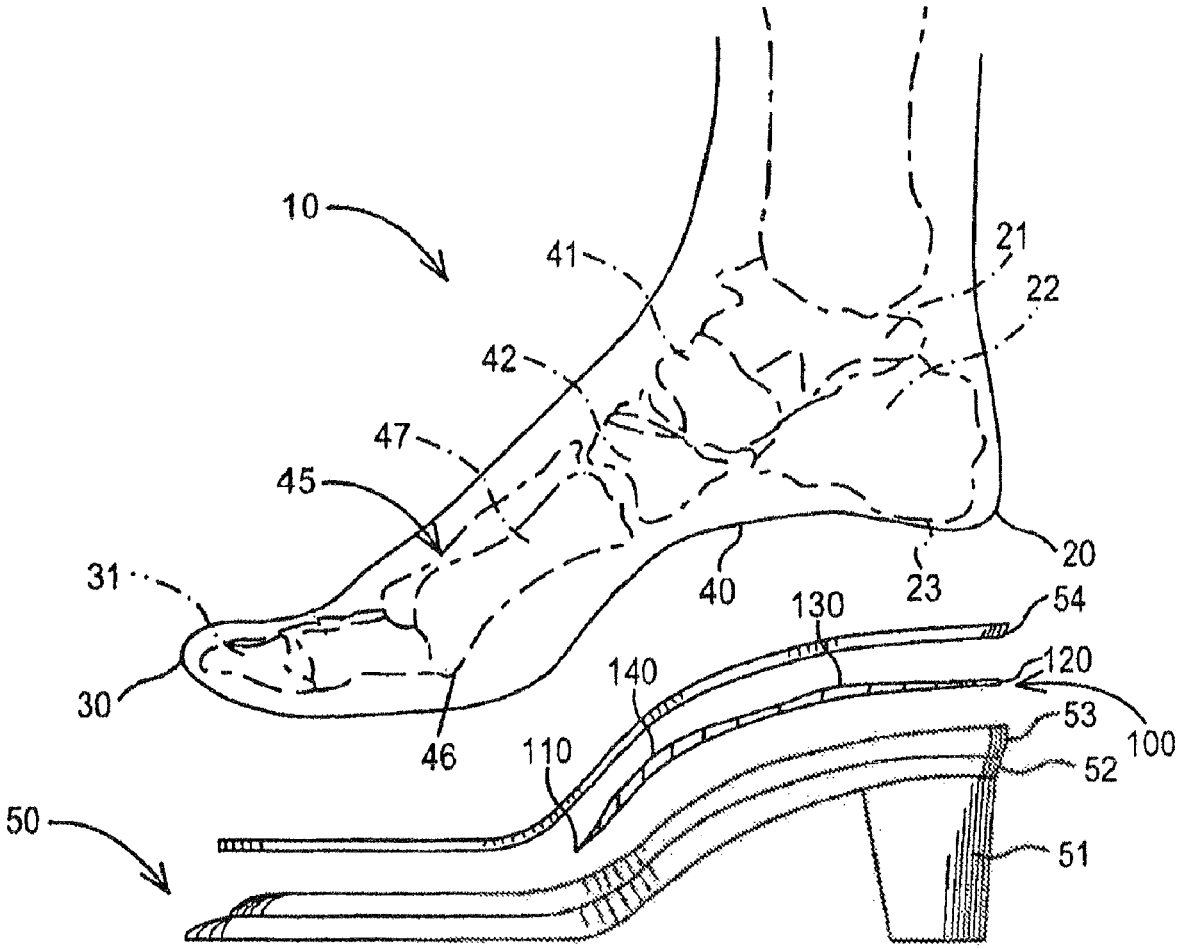
FIG. 5 is a diagrammatic cross-sectional view of the foot bones and a partially exploded view of the portions of a conventional high-heeled shoe that underlie the sole of the foot into which the device of the present invention shown in FIG. 2 has been inserted.

FIGS. 3-5 illustrate an exemplary embodiment of a device 100 consistent with the invention. The device 100 is formed from a flexible material, e.g., molded flexible plastic or rubber, such as polyurethane, thermoplastic elastomer (TPE), thermoplastic rubber (TPR), polyvinyl chloride (PVC) or ethylene vinyl acetate (EVA). The raised areas of the device have a Shore A hardness between about 20 and 90, and preferably have a Shore A hardness of about 30 to 50, and most preferably about 40. The entire device preferably but not necessarily is of the same hardness. The device 100 has a metatarsal end 110 and a heel end 120. The device includes two raised areas 130 and 140. The first raised area 130, located in the rear region, is generally crescent-shaped and positioned in a shoe to underlie the area immediately in front of the tuberosity 23 of the heel bone or calcaneus 22 of the wearer's foot. The crescent-shaped first raised area 130 rises from the rear of the device so that the crescent is oriented as shown in FIGS. 3-5. References herein to this raised area rising from the rear of the device mean the direction of the rise and the orientation of the crescent. Therefore, when the device extends rearward beyond the tuberosity of the calcaneus, it is to be understood that the raised area need not, and preferably should not, begin to rise from the end of the device.

The second raised area 140 is located in the forward region and is positioned to underlie the metatarsal shafts 47 of the wearer's foot. Optimally, the apex of the second raised area is located under or between the second and third metatarsal shafts. The second raised area comprises a generally rounded or ellipsoid shape that rises to an apex toward the direction of the metatarsal heads. The forward raised area preferably has a thinner aspect located towards the heel end 120 and a wider aspect located towards the front end 110.

The apices of the raised areas are preferably 2 to 8 mm higher than the upper surface of the device immediately forward of the forward raised area under the metatarsal shafts and immediately rearward of the raised area under the calcaneus. In the preferred embodiment the apices are of similar or the same height. Preferably, each apex is higher for higher heeled shoes and lower for lower heeled shoes. Also each apex is preferably lower for smaller sized shoes and higher for larger sized shoes. In the most preferred embodiment each apex is approximately 3 mm for a US size 1 women's shoe and approximately 6 mm for a US size 16 women's shoe (or their equivalents in other, e.g. English, European and Japanese shoe size scales) having a heel height of 1 to 5 inches. The area covered by the raised regions also changes with shoe size with the size of the area increasing with increasing length and/or width. Typically the size of the bump both in terms of height and area is scaled to the shoe size with normal rules of scaling applying as the length and width of the shoes increases with increasing size. However, it has been found that a small range of sizes can use an identical device without significant loss of the improved comfort associated with the device. The limiting factor on the comfort achieved with the device of the invention appears to be the location of the apices of the two raised regions—under the calcaneus but forward of the tuberosity of the calcaneus and under the middle metatarsals but rearward of the heads of the metatarsals.

The proximal and the distal ends of the device, i.e., underlying the back of the heel and forward of raised area 140 are thin relative to the raised areas. Preferably these proximal and distal ends have a depth that results in their being flush with the upper surface of the shoe upper where it wraps around the upper surface of the insole board. Preferably the ends are also shaped to conform somewhat to the area extending between the edges of the upper that lie on the surface of the insole board. The thickness of these ends of the device will typically be from 0.2 to 1 mm thick.

Figure 6:
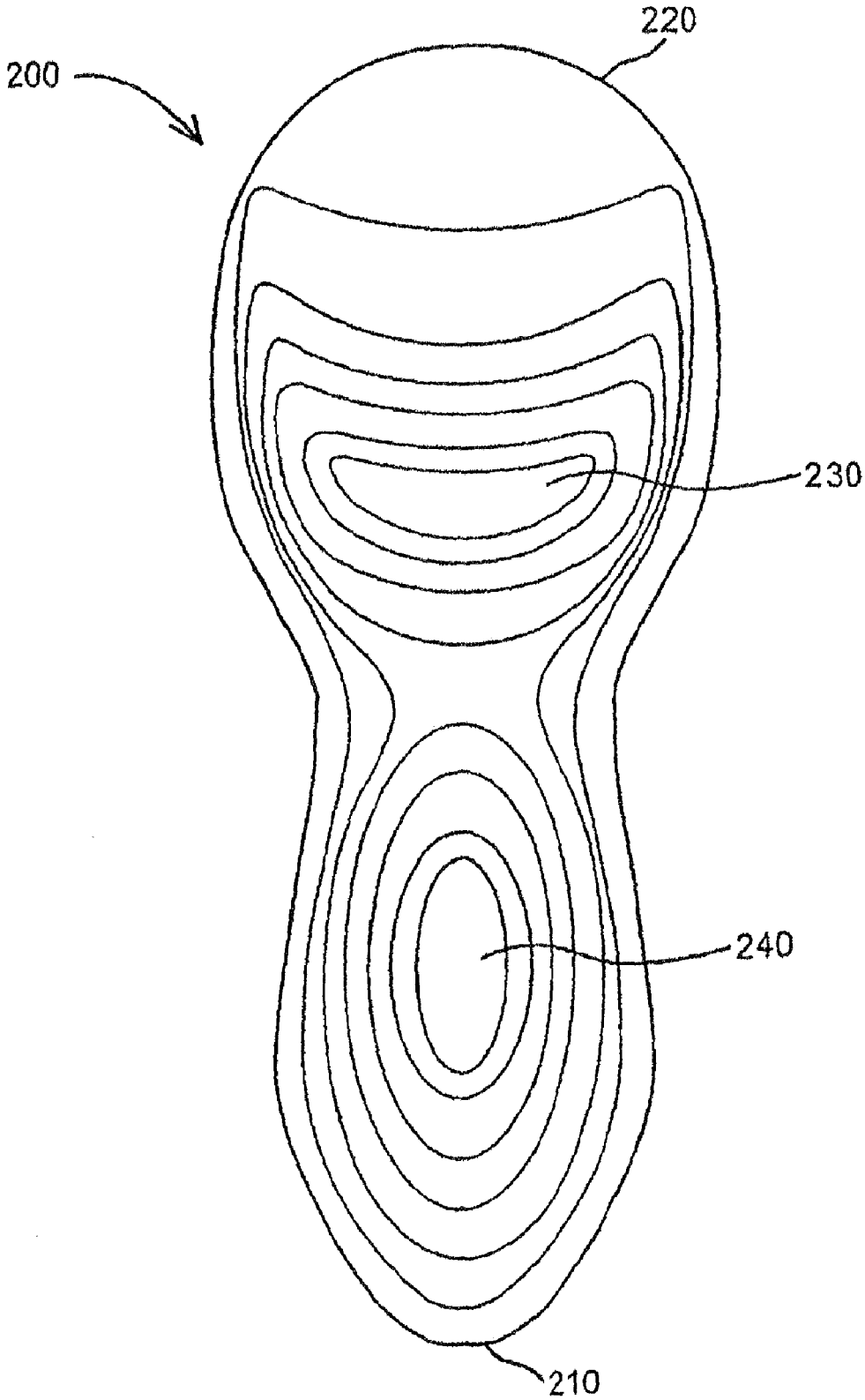
FIG. 6 is a plan view of an alternative embodiment of the invention.

The bridging or middle section or area of the device between the first raised area 130 and second raised area 140 is also preferably thin relative to the raised areas. The thickness of this area is in part dictated by issues of structural integrity during the manufacturing process for the shoe. With stronger materials this area can, and ideally should be, no more than a millimeter thick. In general, this bridging or middle section or area must be thinner than the raised areas 130 and 140, and preferably is no more than about 4 millimeters thick, more preferably about 2 mm thick for a US size 6 women's shoe and about 3 mm for a US size 10 women's shoe (or their equivalents in other size scales). This thinner bridging or middle region allows the device to more easily conform to the shape of the insole. The minimum width of this bridging or middle region is also dictated by manufacturing considerations with the optimal minimum width being that which will maintain the geometry of the forward and rear regions relative to each other. The maximum width is that which will not interfere with the appearance of the shoe. Preferably this bridging or middle region is narrower than the insole board and, like the ends of the device, the bridging or middle region sits flush with the upper surface of the upper that wraps around the insole board and generally conforms to the shape of the area created by the edges of the upper on the insole board FIG. 6 describes an alternative embodiment 200 of the device in which the forward region 210 and middle or bridging region are narrower than the rear region 220. The forward apex is element 240 and the rear apex is element 230.

It should be noted that, contrary to the teachings of the prior art, rather than providing a raised area for supporting the arch of the wearer's foot in the device of the present invention, at least a portion of the bridging or middle region underlying the arch is thinner than the apices of the first and second raised areas 130, 140. That is to say, where a traditional arch support normally would be located in the shoe at least a portion of the area underlying the arch of the foot is hollowed or lower than adjacent areas leaving the arch unsupported in part.

Preferably, the upper surface of the device is smoothly contoured, with no sharp transitions or edges that could contribute to discomfort. Specifically, the transition between the apices of the raised areas and the surrounding areas of the device are smooth.

As described above, the invention contemplates a single flexible device into which both raised areas are incorporated. The invention also contemplates two separate flexible devices, each of which embodies one of the above-described raised areas and which together achieve the advantages of the invention. The invention also contemplates a single flexible device which embodies one or the other of the above raised areas and which is used in conjunction with a shoe or shoe part which incorporates the other raised area. Finally, the invention contemplates shoes into which any of the foregoing described embodiments of the device has been incorporated.

The device 100 preferably is positioned in shoe 50 during the manufacturing process. Accordingly, this invention also provides a method of constructing a high-heeled shoe comprising: (a) assembling an upper, insole board and sole; (b) mounting above the insole board a flexible device comprising (i) a rear region positioned to underlie the calcaneus in the area forward of the forward edge of the tuberosity of the calcaneus, the upper surface of said rear region having a portion which gradually rises from the rear of the device to a crescent shaped apex, said apex lying under the area forward of the tuberosity of the calcaneus; (ii) a forward region positioned to underlie at least a portion of the shafts of the metatarsals, the upper surface of said forward region having a portion which gradually rises to an apex positioned to underlie the shafts of the second and third metatarsals from a position behind the heads of metatarsals; (iii) a bridging or middle region which connects said forward and rear regions; and (iv) the upper surface of said device transitioning smoothly between all regions; and (c) affixing a sock liner to the insole board and to the device. The order in which these steps are done is the choice of the manufacturer. In a preferred embodiment of the invention, the device 100 is positioned on the insole board 53 of the shoe 50, and then a sock liner 54 is adhered to the top of the insole board and the device 100. It is also contemplated that the device 100 may be installed post-manufacture or post-sale in certain embodiments, e.g., by being placed on the insole board 53 or sock liner 54 post-manufacture. The device 100 may be attached to the insole board 53 and the sock liner 54 through means such as glue, pressure-sensitive adhesive (PSA), hook and loop, e.g., Velcro®, or mechanical fasteners such as nails or staples. In general, any means that will cause the raised areas of the device to remain in position may be used to position the device in the shoe. Device 100 also need not be separate from the sock liner but may be integral with the sock liner.

In order to facilitate proper positioning of the device, the device may be provided with an markings or structure that orient the device. These markings may be arrows or the device itself may be configured with a point which serves to orient the device.

The two raised areas may be made as separate pieces and individually positioned in a shoe. In that case, the region between the two raised areas of the device is integral with the insole board or the sock liner and need not be flexible. A further manufacturing alternative is to incorporate one of the raised areas into the insole board and again this incorporated raised area need not be flexible. Yet a further alternative is to incorporate one or both raised areas into the sock liner. However, for ease of manufacture, a single device having the separate raised areas joined by a bridging or middle section is preferred. In all cases, the portions of the device that are mounted on the insole board of a shoe must be flexible enough to readily conform to the upper surface of the insole board on which they are mounted.

The device of the present invention provides unexpected advantages over the prior art. For example, although the rear raised area is only a few millimeters high the device causes the weight borne by the foot to be significantly shifted towards the heel and off the ball of the foot. As a result, the device reduces toe pain and general lower back pain associated with the wearing of heeled shoes. Thus, foot pain, endemic with the use of high-heeled shoes, is reduced or eliminated using the instant device. The device also repositions the ankle for increased stability.

In addition, this device does not require any change in the lasts used to manufacture conventional shoes; rather, the device can simply be placed into the conventionally constructed shoe either by the manufacturer or by the wearer. Nor does this device significantly affect the fit of the shoe as it does not intrude substantially into the shoe and thereby diminish the space available for the foot.

What is claimed is:

1. In a high-heeled shoe having a sole, an upper and an insole board, the improvement comprising a two piece device which is mounted on the insole board, said two piece device having:

a. a first piece including a rear region having an upper surface and positioned on the portion of the insole board that underlies at least the area of a wearer's calcaneus forward of the forward edge of the tuberosity of the calcaneus, said upper surface of said rear region having a raised portion which gradually rises from the rear of the device to a crescent shaped apex, said apex lying under the area forward of the tuberosity of the calcaneus; and b. a second piece including a forward region having an upper surface and positioned on the portion of the insole board that underlies at least a portion of the shafts of the wearer's metatarsals, said upper surface of said forward region having a raised portion which gradually rises to an apex positioned to underlie the shafts of the wearer's second and third metatarsals, said raised portion of said second piece having an ellipsoid shape such that it is wider toward the wearer's metatarsals and tapers toward the rear of the metatarsal shafts;

said first piece and the second piece being spaced from one another on said insole board wherein the device causes the weight borne by a wearer's foot to be shifted towards the heel and off the ball of the foot.

2. The shoe according to claim 1, wherein the apex of the raised portion of the second piece is 2 to 8 mm high relative to the surface immediately forward of the raised portion.

3. The shoe according to claim 2, wherein the height of the apex of the raised portion of the second piece is scaled relative to the size and height of the shoe.

4. The shoe according to claim 3, wherein the apex of the raised portion of the second piece ranges from 3 mm for a US size 1 women's shoe to 6 mm for a US size 16 women's shoe.

5. The shoe according to claim 1, wherein the apex of the raised portion of the first piece is 2 to 8 mm high relative to the surface immediately rearward of the raised portion.

6. The shoe according to claim 5, wherein the height of the apex of the raised portion of the first piece is scaled relative to the size and height of the shoe.

7. The shoe according to claim 6, wherein the apex of raised portion of the first piece ranges from 3 mm for a US size 1 women's shoe to 6 mm for a US size 16 women's shoe.

8. The shoe according to claim 1, wherein the device is flexible.

9. The shoe according to claim 1, wherein the raised portions are the thickest portions of the device.

10. The shoe according to claim 1, wherein all portions of the first and second pieces other than the raised portions and the transitions from the raised portions to the remaining portions of the first and second pieces are no more than 0.5 to 1 mm thick.

11. The shoe according to claim 1, wherein the raised portions of the first and second piece are of approximately the same height.

12. The shoe according to claim 1, wherein the first and second pieces have a Shore A hardness of 20 to 90.

13. The shoe according to claim 1, wherein the first and second pieces have a Shore A hardness of 35 to 50.

14. The shoe according to claim 1, wherein the first and second pieces have a Shore A hardness of about 40.

15. The shoe according to claim 1, wherein the first and second pieces are of approximately the same Shore A hardness throughout.

16. In a high-heeled shoe having a sole, an upper and an insole board, the improvement wherein said insole board has a surface contour having:

a. a rear region having an upper surface and positioned on the portion of the insole board that underlies at least the area of a wearer's calcaneus forward of the forward edge of the tuberosity of the calcaneus, said upper surface of said rear region having a portion which gradually rises from the rear of the device to a crescent shaped apex, said apex lying under the area forward of the tuberosity of the calcaneus;

b. a forward region having an upper surface and positioned on the portion of the insole board that underlies at least a portion of the shafts of the wearer's metatarsals, said upper surface of said forward region having a raised portion which gradually rises to an apex positioned to underlie the shafts of the wearer's second and third metatarsals, said raised portion of said forward region having an ellipsoid shape such that it is wider toward the wearer's metatarsals and tapers toward the rear of the metatarsal shafts; and c. a middle region thinner than the heights of the rear and forward regions at the apices of their respective upper surfaces, which connects said rear and forward regions, said middle regions having an upper surface which is smoothly contoured, wherein the surface contour causes the weight borne by a wearer's foot to be shifted towards the heel and off the ball of the foot.

17. The shoe according to claim 16, wherein the apex of the raised portion of the forward region is 2 to 8 mm high relative to the surface immediately forward of the raised portion.

18. The shoe according to claim 17, wherein the height of the apex of the raised portion of the forward region is scaled relative to the size and height of the shoe.

19. The shoe according to claim 18, wherein the apex of the raised portion of the forward region ranges from 3 mm for a US size 1 women's shoe to 6 mm for a US size 16 women's shoe.

20. The shoe according to claim 16, wherein the apex of the raised portion of the rear region is 2 to 8 mm high relative to the surface immediately rearward of the raised portion.

21. The shoe according to claim 20, wherein the height of the apex of the raised portion of the rear region is scaled relative to the size and height of the shoe.

22. The shoe according to claim 21, wherein the apex of raised portion of the rear region ranges from 3 mm for a US size 1 women's shoe to 6 mm for a US size 16 women's shoe.

23. The shoe according to claim 16, wherein the thinner portion of the middle region extends from the medial side of the device to the lateral side of the insole board.

24. The shoe according to claim 16, wherein the raised portions are the thickest portions of the insole board.

25. The shoe according to claim 16, wherein the raised portions of the rear and forward regions are of approximately the same height.

26. In a high-heeled shoe having a sole, an upper and an insole board having a forward region that underlies at least a portion of the shafts of a wearer's metatarsals and has an upper surface, the upper surface having a raised portion which gradually rises to an apex positioned to underlie the shafts of the wearer's second and third metatarsals, said raised portion having an ellipsoid shape such that it is wider toward the wearer's metatarsals and tapers toward the rear of the metatarsal shafts, the improvement wherein the insole board has a raised area that underlies at least the area of the calcaneus forward of the forward edge of the tuberosity of the wearer's calcaneus, an upper surface of said raised area having a portion which gradually rises from the rear to a crescent shaped apex, said apex lying under the area forward of the tuberosity of the calcaneus, wherein the raised area causes the weight borne by a wearer's foot to be shifted towards the heel and off the ball of the foot.

27. The shoe according to claim 26, wherein the apex of the raised area is 2 to 8 mm high relative to the surface immediately rearward of the raised area.

28. The shoe according to claim 27, wherein the height of the apex of the raised area is scaled relative to the size and height of the shoe.

29. The shoe according to claim 28, wherein the apex of raised area ranges from 3 mm for a US size 1 women's shoe to 6 mm for a US size 16 women's shoe.

* * * * *